US007625276B2

(12) United States Patent
Kim et al.

(10) Patent No.: US 7,625,276 B2
(45) Date of Patent: Dec. 1, 2009

(54) SHROUD FOR AXIAL FLOW FAN

(75) Inventors: Jong-Yeol Kim, Seoul (KR); Jun-Ho Kim, Seoul (KR)

(73) Assignee: Halla Climate Control Corporation, Daejeon-si (KR)

( * ) Notice: Subject to any disclaimer, the term of this patent is extended or adjusted under 35 U.S.C. 154(b) by 0 days.

(21) Appl. No.: 11/531,411

(22) Filed: Sep. 13, 2006

(65) Prior Publication Data

US 2007/0060037 A1 Mar. 15, 2007

(30) Foreign Application Priority Data

Sep. 13, 2005 (KR) ..... 10-2005-0084909

(51) Int. Cl.

| | |
|---|---|
| ***F24F 7/06*** | (2006.01) |
| ***H05K 5/00*** | (2006.01) |
| ***F03B 11/02*** | (2006.01) |
| ***F03D 1/04*** | (2006.01) |
| ***B60K 11/00*** | (2006.01) |
| *F03K 11/02* | (2006.01) |

(52) U.S. Cl. ..... 454/228; 454/184; 415/211.2; 415/208.2; 415/220; 180/68.1

(58) Field of Classification Search ..... 454/184; 415/211.2, 173.5

See application file for complete search history.

(56) References Cited

U.S. PATENT DOCUMENTS 5,775,450 A * 7/1998 Porter et al. ..... 180/68.1
6,027,307 A * 2/2000 Cho et al. ..... 415/173.5
6,142,213 A * 11/2000 Gallivan et al. ..... 165/41
6,910,862 B2 * 6/2005 Horng et al. ..... 415/211.2
2005/0063822 A1 * 3/2005 Horng et al. ..... 415/211.2

FOREIGN PATENT DOCUMENTS

| | | |
|---|---|---|
| JP | 56-162469 | 12/1981 |
| JP | 2005-061308 | 10/2005 |

* cited by examiner

*Primary Examiner*—Steve McAllister
*Assistant Examiner*—Helena Kosanovic
(74) *Attorney, Agent, or Firm*—Lowe Hauptman Ham & Berner LLP

(57) ABSTRACT

An axial flow fan shroud fixes and supports the axial flow fan and a driving motor while surrounding the axial flow fan. The shroud includes a housing having a ventilation hole at the center of the housing and surrounding the axial flow fan; a motor fixing part at the center of the ventilation hole; and air guide vanes or duct between the housing and the motor fixing part for deflecting a part of air blown by the axial flow fan parts needing cooling. The shroud prevents overheating of parts sensitive to heat due to heat of an engine by guiding air blown by the axial flow fan to an area where the parts are installed while avoiding the heated engine. Therefore, low-price products having inferior thermal property can be used so manufacturing costs can be reduced and the degree of freedom in design can be improved.

5 Claims, 8 Drawing Sheets

PRIOR ART

PRIOR ART

PRIOR ART

SHROUD FOR AXIAL FLOW FAN

RELATED APPLICATION

The present application is based on, and claims priority from, KR application No. 10-2005-0084909, filed Sep. 13, 2005, the disclosure of which is hereby incorporated by reference herein in its entirety.

BACKGROUND OF THE INVENTION

1. Field of the Invention

The present invention relates to a shroud for an axial flow fan wherein the shroud surrounds the axial flow fan and fixes and supports the axial flow fan and an axial flow fan driving motor and more particularly, to a shroud for an axial flow fan, which can guide a part of air blown by the axial flow fan in a direction in which parts requiring cooling are installed.

2. Background Art

An axial flow fan is a fluid machine for axially blowing air by rotating a plurality of blades radially arranged. In general, the axial flow fan constitutes an axial flow fan shroud assembly together with a shroud for axially guiding air whiling surrounding the axial flow fan.

The axial flow fan shroud assembly for an automobile is used to promote heat radiation of an air-cooled type heat exchanger, such as a radiator or a condenser, and blows air to the heat exchanger. The axial flow fan shroud assembly is classified into a pusher type and a puller type according to an arrangement form of the heat exchanger.

The pusher type axial flow fan shroud assembly adopts a method that the axial flow fan forcedly blows air from the front of the heat exchanger toward the back. Such a pusher type axial flow fan shroud assembly is used in a case that a space formed at the back of the heat exchanger inside an engine compartment is small since it provides a low air-blowing efficiency to the heat exchanger. Meanwhile, the puller type axial flow fan shroud assembly adopts a method that the axial flow fan located at the back of the heat exchanger sucks the forward air of the heat exchanger thereby to pass the air through the heat exchanger. The puller type is applied to most of automobiles since it provides higher air-blowing efficiency than the pusher type.

In the axial flow fan shroud assembly, as shown in FIGS. 1 and 2, the shroud fixes and supports the axial flow fan 2 on the rear side of the heat exchanger 20 and axially guides air sucked by the axial flow fan 2 in front of the heat exchanger. As shown in FIGS. 1 and 2, the shroud generally includes: a housing 10, a plurality of arms 11 centripetally extending from the inner peripheral surface of a ventilation hole 10*a* formed in the housing 10; and a motor fixing part 12 supported by the arms 11 for fixing and supporting an axial flow fan driving motor 3.

The housing 10 is in the form of an approximately rectangle corresponding to the heat exchanger 20, so that the front surface of the housing 10 is in contact with the entire rear surface of the heat exchanger 20 to enlarge a blowing area against the heat exchanger 20. The housing 10 has brackets formed integrally to the top and bottom thereof to be fixed on the heat exchanger 20. The ventilation hole 10*a* formed at the center of the housing 10 is in a circular form of a size large enough to surround the axial flow fan 2 as some interval to enhance blowing efficiency by reducing a loss of wind pressure of the axial flow fan 2.

Meanwhile, a function of the prior art axial flow fan shroud adopted to the automobile is restricted to transfer negative pressure by air blast of the axial flow fan 2 to the entire heat exchanger 20 while fixing the axial flow fan 2 and the driving motor 3. However, on the rear side of the shroud, components weak to heat, such as an alternator 35 are mounted. The alternator 35 is a device to generate electricity using a rotation of the engine during traveling of the automobile. Electricity generated by the alternator 35 charges a battery, and then used to operate electric machines of the automobile. The alternator 35 must not to be exposed to heat and needs to rapidly emit heat generated during an electricity generating process since it is equipped with parts made of insulating material weak to heat for heat-insulation between the parts to generate electricity.

If the parts weak to heat are displaced from an axial direction of the shroud ventilation hole 10*a* and deflectively mounted to one side due to a special restriction, or if they are mounted beneath the motor 3, cool air cannot be blown to the part, and axially blown air is dispersed into the engine compartment in a heated state after being pumped to a high-temperature engine 30, whereby it may have a fatal influence on performance and lifespan of the parts weak to heat.

That is, as shown in FIG. 3, since the engine 30 is located at the lower part of the rear side of the axial flow fan shroud assembly, air blown axially by the axial flow fan 2 is pumped to the engine 30 located at the back of the axial flow fan 2 to stop a smooth flow of air. Thereby, blown air is dispersed into the engine compartment in the heated state by the engine 30, so that all parts mounted inside the engine compartment are influenced by heat that may cause a fatal influence on the performance and lifespan of the parts weak to heat.

Therefore, in the case where the parts sensitive to heat are arranged at locations displaced from the axial direction of the axial flow fan 2 or beneath the motor, if the prior art axial flow fan shroud is adopted, products of high quality and high price having superior thermal properties must be used on the parts, and so, a high cost must be paid due to a rise of manufacturing prices.

Meanwhile, Japanese Patent Laid-open Publication No. 2005-61308 discloses a cooling device for a construction machine, which can uniformly distribute suction air to cores horizontally arranged in front of a cooling fan by horizontally expanding a suction area of air blowing by the cooling fan. In addition Japanese Utility Model Laid-open Publication No. 56-162469 discloses an axial flow fan shroud for a radiator, which has a distributing plate mounted at a position displaced outwardly from an axial direction of the axial flow fan in front of the axial flow fan for guiding an air flow toward the axial flow fan, so that the axial flow fan can suck and blow air through the radiator.

While such prior art shrouds enhance the cooling efficiency of the heat exchanger by uniformly distributing air sucked by the axial flow fan to the entire heat exchanger mounted in front of the axial flow fan, they do not change the flow direction of air blown toward the back of the axial flow fan. Therefore, in the case where the parts weak to heat due to the special restriction must be arranged at a position displaced from the axial direction of the axial flow fan in the downstream part of the axial flow fan, air blown by the axial flow fan cannot be induced toward the parts. Therefore, the prior has the above problems of the axial flow fan shroud.

SUMMARY OF THE INVENTION

Accordingly, the present invention has been to solve the above-mentioned problems occurring in the prior art, and it is an object of the present invention to provide a shroud for an axial flow fan that can cool by guiding a part of air blown by the axial flow fan toward parts, which are sensitive to heat and mounted in a direction deflected from an axial direction of the axial flow fan or beneath a motor.

To accomplish the above objects, according to the present invention, a shroud for an axial flow fan includes: a housing having a circular ventilation hole that surrounds the axial flow fan; a motor fixing part for fixing and supporting a driving motor at the center of the ventilation hole; a plurality of arms centripetally extending at a plurality of points on the inner peripheral surface of the ventilation hole for supporting the motor fixing part; and a plurality of arcuately-shaped air guide vanes (a) located in the hole and adapted to be downstream of blades of the fan and (b) inclined with respect to the axial flow direction of air blown by the fan and radially displaced from each other and extending over an angular range in a circumferential direction between two adjacent arms supporting the motor fixing part, the air guide vanes being located in only one area of plural areas formed by each adjacent pair of arms and located in only one area. Alternatively, a guide duct is formed between the motor fixing part and the inner peripheral surface of the ventilation hole.

The axial flow fan shroud can guide a part of air blown by the axial flow fan in a specific direction eccentric from an axial direction of the axial flow fan by the guide means, namely, guide vanes. Therefore, in the case where parts sensitive to heat are displaced from the axial direction of the axial flow fan to one side on the downstream side of the axial flow fan, the present invention can guide and cool a part of air blown by the axial flow fan to prevent malfunction or reduction of durability and lifespan of the parts due to overheat.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
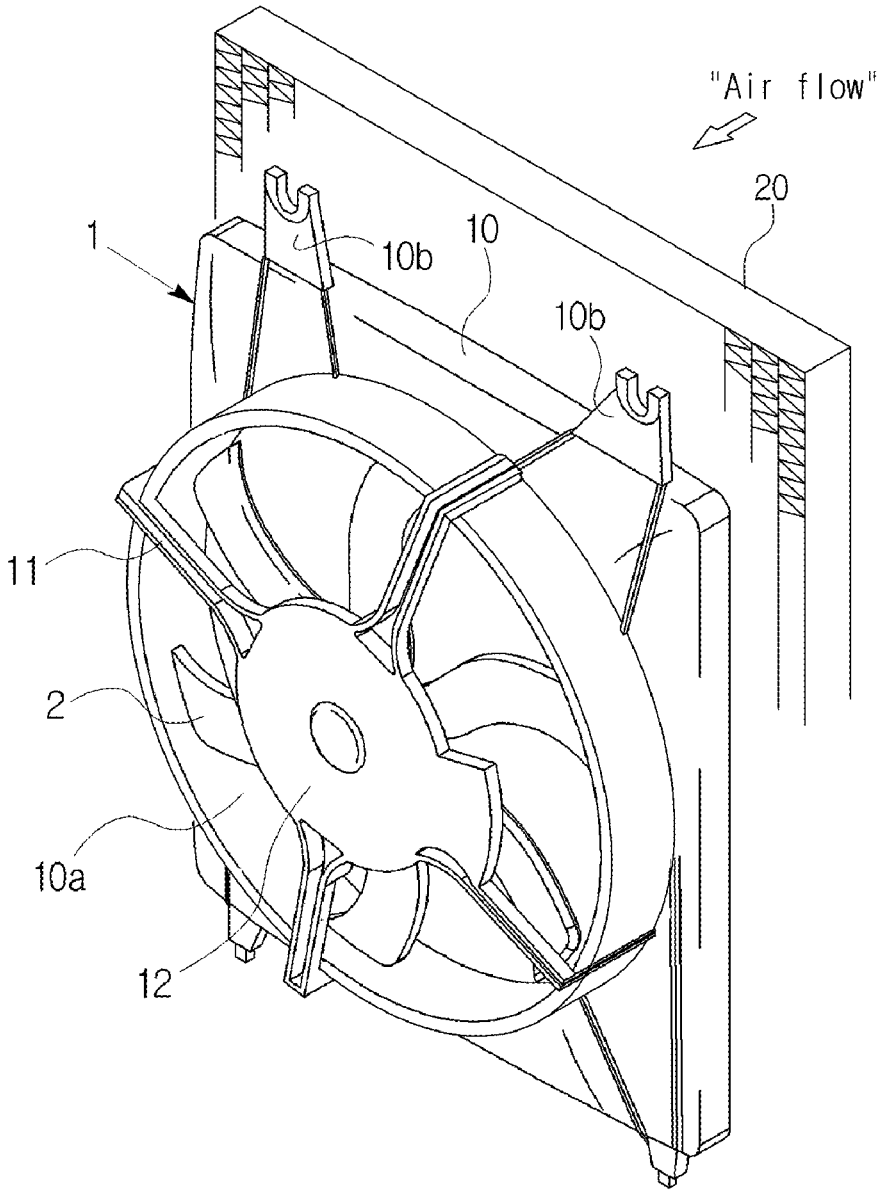
FIG. 1 is a rear perspective view of a prior art axial flow fan shroud.
Figure 2:
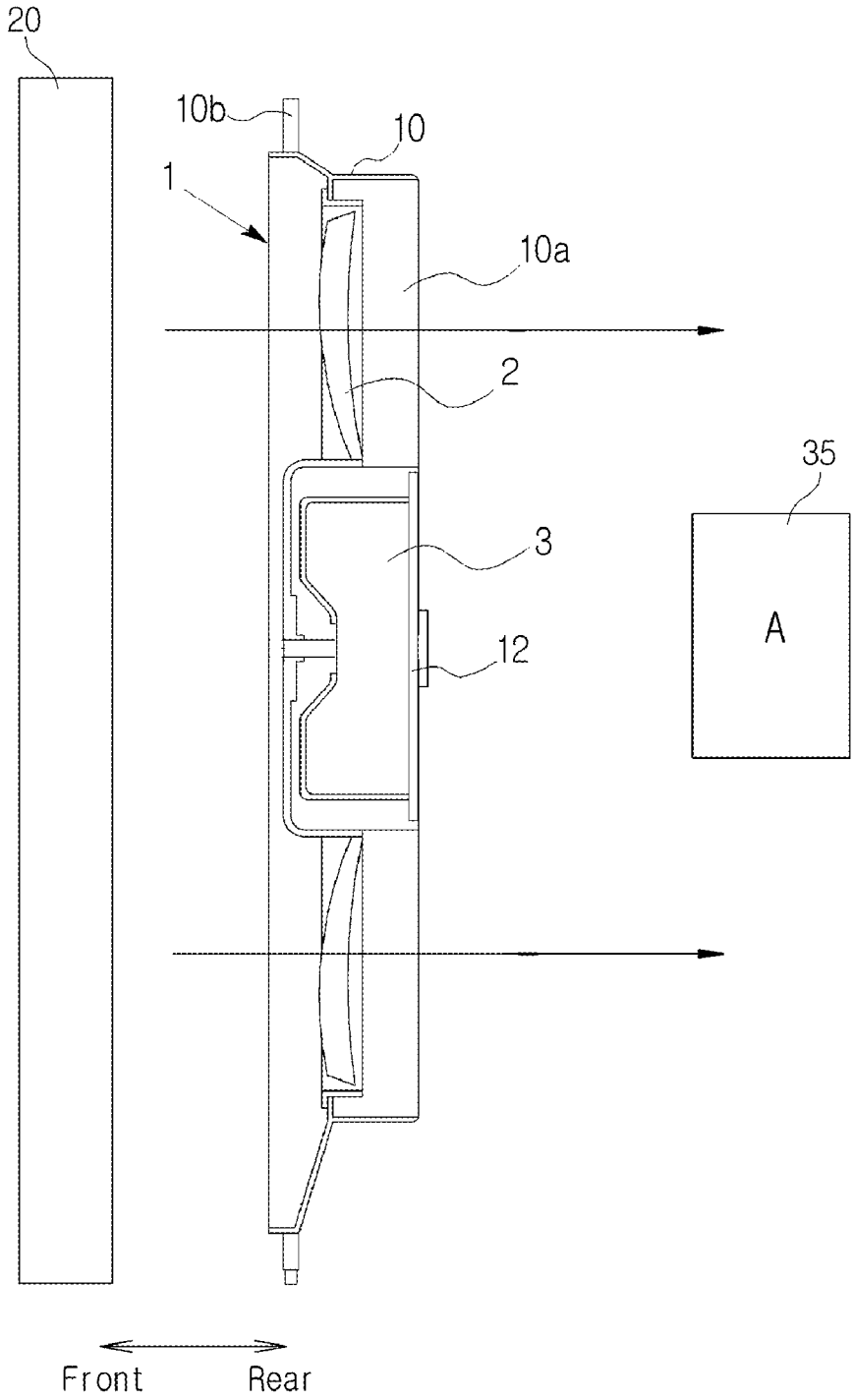
FIG. 2 is a side sectional view of the prior art axial flow fan shroud.
Figure 3:
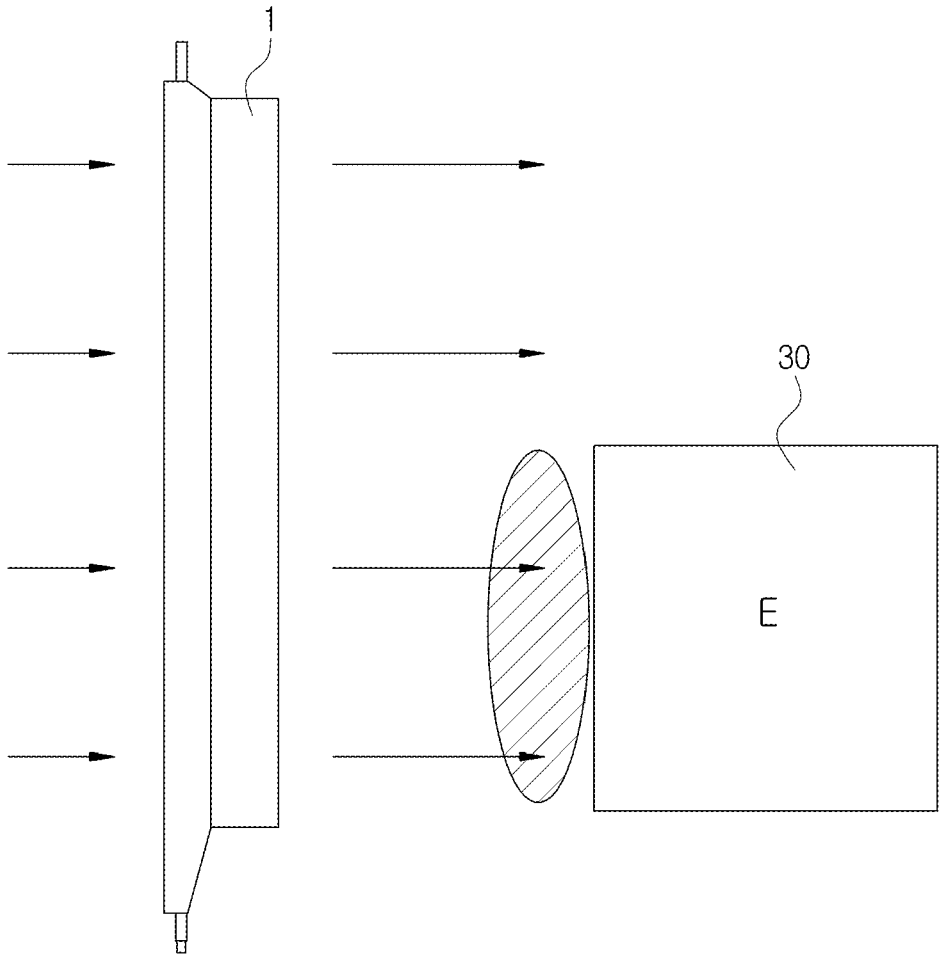
FIG. 3 is a view showing an air flow around an engine by the prior art axial flow fan.
Figure 4:
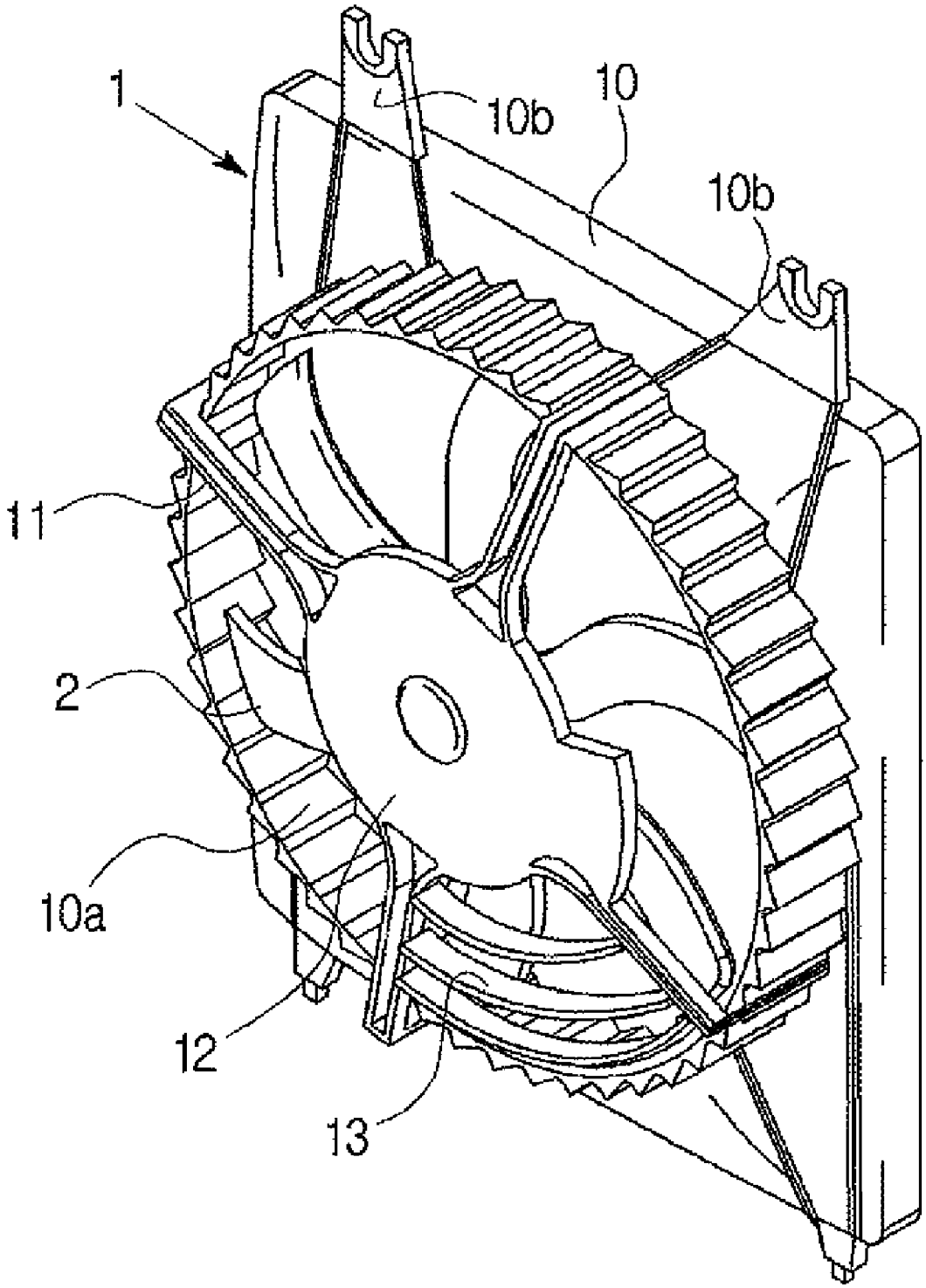
FIG. 4 is a rear perspective view of a shroud for an axial flow fan according to a first preferred embodiment of the present invention.
Figure 5:
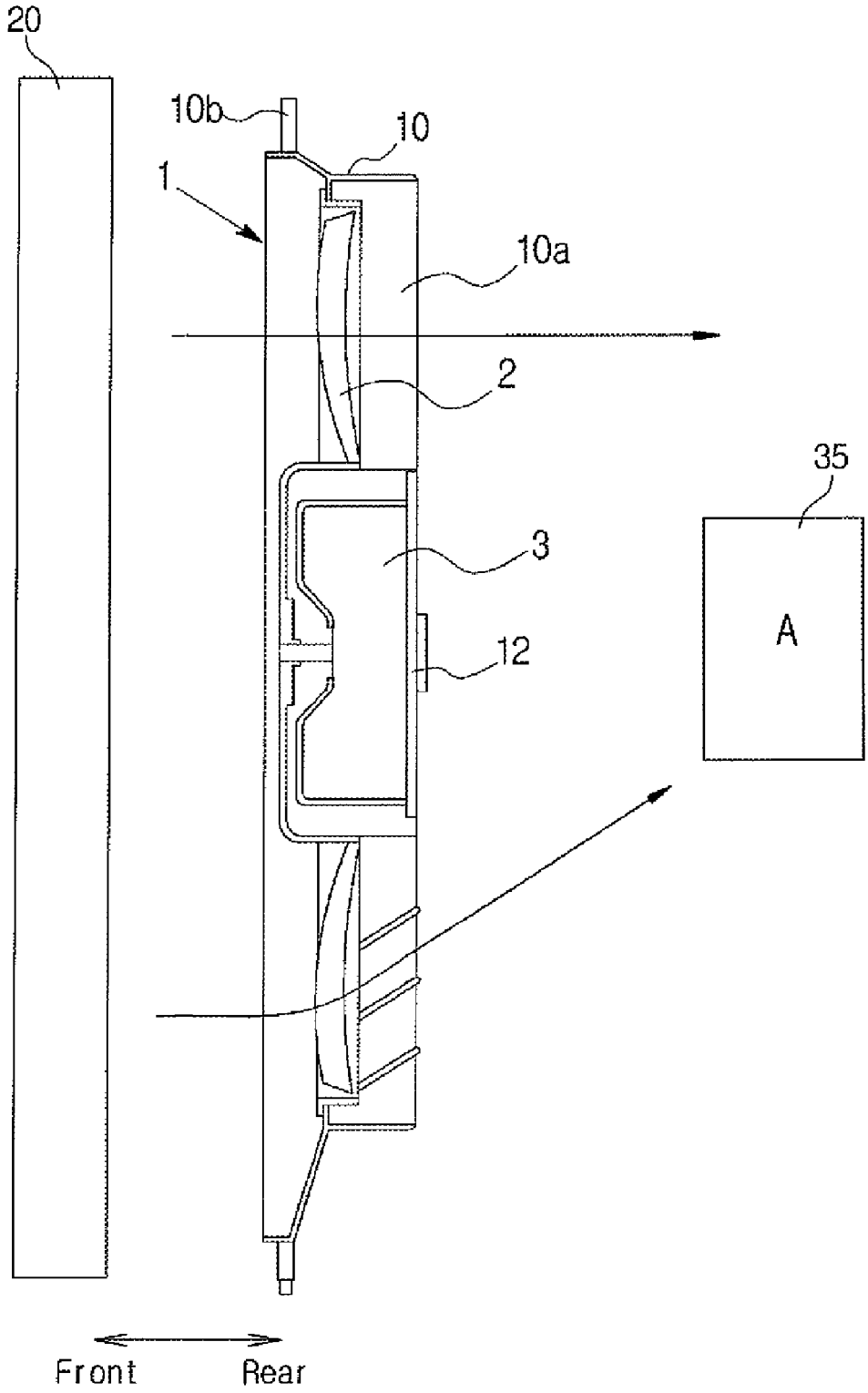
FIG. 5 is a side sectional view of the shroud for the axial flow fan according to the first preferred embodiment.

FIG. 4 is a rear perspective view of a shroud for an axial flow fan according to a first preferred embodiment of the present invention, and FIG. 5 is a side sectional view of the shroud for the axial flow fan.

As shown in FIG. 4, the shroud for the axial flow fan according to the first preferred embodiment of the present invention includes: a housing 10 having a ventilation hole 10*a* (1) formed at the center of housing 10 and surrounding an axial flow fan 2; (2) a motor fixing part 12, located at the center of the ventilation hole 10*a*, for fixedly supporting a driving motor 3; a plurality of arms 11 centripetally extending from several points of the inner peripheral surface of housing 10 around the ventilation hole 10*a* for supporting the motor fixing part 12; and guide vanes 13, which are guide means, for guiding a part of air blown by the axial flow fan 2 to one side.

Since the guide means is located inside a rotational area of the axial flow fan 2, a strong wind can be directly guided from the axial flow fan 2 toward a place where parts weak to heat, such as an alternator 35, are installed, namely, a wanted area. Because the guide means is located inside the rotational area of the axial flow fan 2 the guide means can be considered as being located at an area where the guide means overlaps with the axial flow fan 2, when the guide means is seen from the axial direction. Therefore, air blown by the axial flow fan 2 is in direct contact with the guide means and guided to the wanted area.

The housing 10 is made of synthetic resin material molded into an approximately rectangular form corresponding to the shape of a heat exchanger, so that the front surface of the housing can be in contact with the entire rear surface of the heat exchanger. The housing 10 has brackets 10*b* formed at the upper and lower sides thereof for fixing the housing to the heat exchanger. The ventilation hole 10*a* is in a circular form and has a size sufficiently large as to surround the axial flow fan 2 as some interval to enhance blowing efficiency by reducing a loss of wind pressure of the axial flow fan 2.

The motor fixing part 12 is mounted at the center of the ventilation hole 10*a* of the housing 10 to fix and support the axial flow fan 2 and the driving motor 3, and supported by a plurality of the arms 11 centripetally extending at the several points of the inner peripheral surface of the ventilation hole 10*a*.

Figure 6:
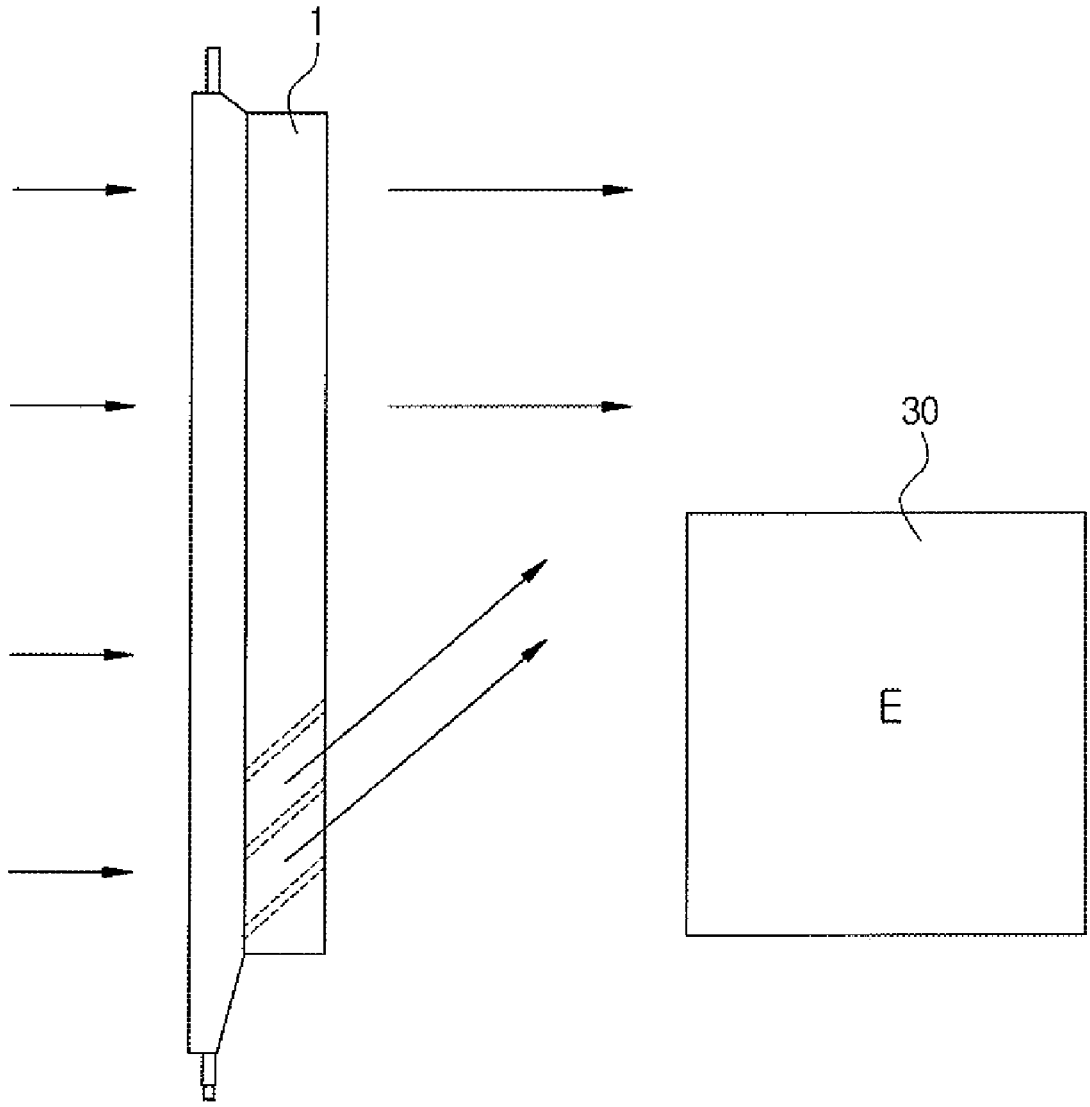
FIG. 6 is a view showing an air flow around an engine according to the first preferred embodiment.

The guide vanes 13 guide a part of air blown by the axial flow fan 2 from the back of the axial flow fan 2 in the specific direction toward the wanted area where alternator 35 is located. It is preferable that the guide vanes 13 are molded between the adjacent arms 11 for supporting the motor fixing part 12 within an angle range restricted to a circumferential direction. In this embodiment, the guide vanes 13 are formed in a space between the arm 11 extending to the left and the arm 11 extending downwardly from the motor fixing part 12 in an area ranging between about 90.degree. to 180.degree. in the clockwise direction from a perpendicular top of the motor fixing part 12, namely, at an area corresponding to a third quadrant when the ventilation hole 10*a* of the rear side is divided into quadrants. In the embodiment of FIGS. 4-6, the guide vanes 13 are radially displaced from each other and have an arcuate extent of about 90° between a pair of adjacent radially extending arms 11 to centripetally guide air blown to the third quadrant by the axial flow fan 2, and vanes 13 are centripetally curved at the downstream side thereof. The installation position and curved direction of the guide vanes 13 can be changed according to positions of the parts requiring cooling.

The shroud for the axial flow fan according to the embodiment of FIGS. 4-6 can centripetally guide a part of air, which is sucked in front of the heat exchanger 20 through the front surface of the housing 10 and blown backwardly by the axial flow fan 2, which the axial flow fan 2, namely, air blown to the third quadrant of the ventilation hole 10*a*, while avoiding the heated engine in a state where the axial flow fan is fixed on the rear side of the heat exchanger. So, the embodiment of FIGS. 4-6 can prevent malfunction or reduction of lifespan of the parts, which are arranged in the air-blowing direction and are sensitive to heat (not shown), due to overheat.

Therefore, according to the embodiment of FIGS. 4-6, in the case where the parts arranged at the back of the shroud 1 and sensitive to heat, such as the alternator, are deflected to one side at the back of the axial flow fan 2 due to the special restriction, overheating is prevented of the parts due to heat of the engine, and so, low-price products which have inferior thermal property can be used.

Figure 7:
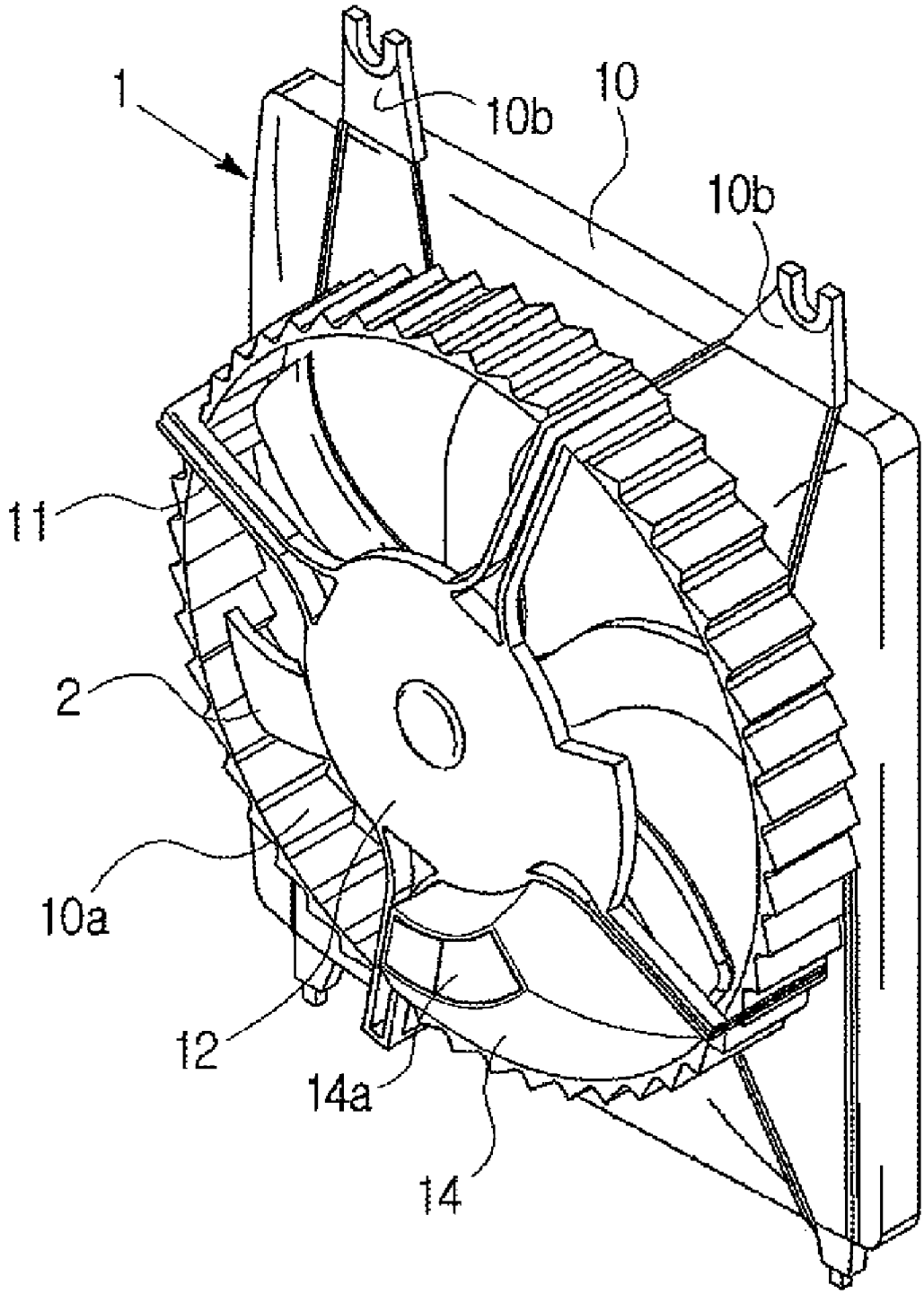
FIG. 7 is a rear perspective view of a shroud for an axial flow fan according to a second preferred embodiment of the present invention.
Figure 8:
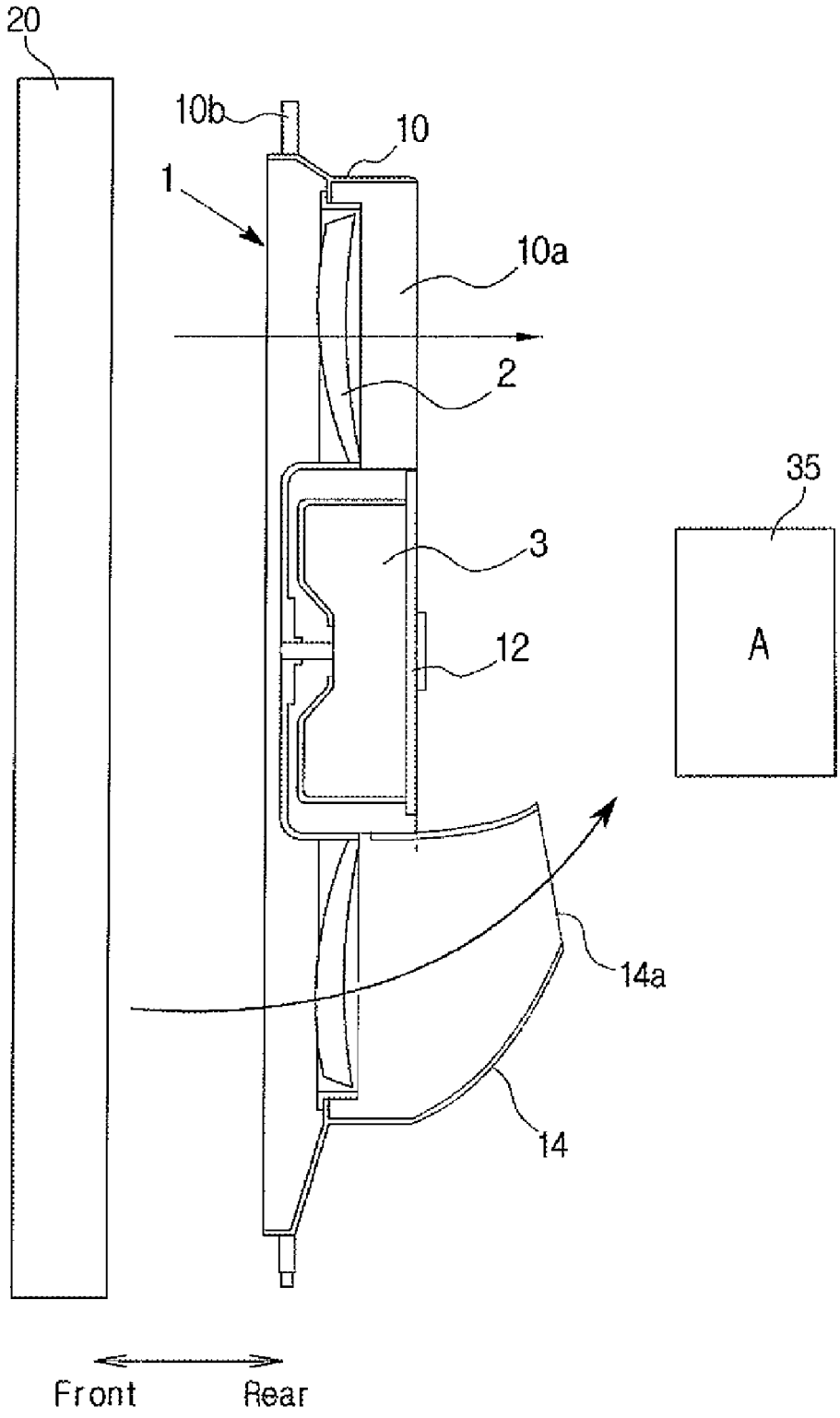
FIG. 8 is a side sectional view of the shroud for the axial flow fan according to the second preferred embodiment.

FIGS. 7 and 8 are respectively a rear perspective view and a side sectional view of a shroud for an axial flow fan according to a second preferred embodiment.

As shown in the drawings, in the second embodiment, the shroud includes the guide means for deflectively guiding air blown by the axial flow fan 2 in the specific direction, wherein the guide means includes a guide duct 14 mounted at a side of the lower portion of the ventilation hole 10 of the rear side of the housing 10 and having an outlet 14 inclined upwardly.

The guide duct 14 is located in the lower part of the ventilation hole 10*a* and upwardly curved toward the downstream side of the airflow. Therefore, air blown by the axial flow fan 2 can be upwardly guided so it is not pumped to the engine 30, and thereby a smooth airflow can be secured.

In the second preferred embodiment, since the guide duct 14 can concentrically guide air blown through the lower portion of the ventilation hole 10*a* in a direction in which the part sensitive to heat are installed while avoiding the heated engine 30, the shroud according to the second embodiment can prevent overheat of the parts sensitive to heat more effectively than the shroud according to the first embodiment.

As described above, the shrouds for the axial flow fan according to FIGS. 4-8 can prevent overheating parts sensitive to heat due to heat of the engine since the axial flow fan guides air toward the area where the parts sensitive to heat are installed while avoiding the heated engine. Therefore, when the parts influenced by heat must be used, the present invention can use low-price products having inferior thermal property without regard to the installation position, whereby manufacturing costs can be reduced and the degree of freedom in design can be improved since there is little restriction in arrangement of the parts.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An automotive vehicle comprising: an engine, a motor driven axial flow fan, a shroud for the motor driven axial flow fan, a heat exchanger and an alternator displaced from the engine relative to an axis of flow for air flowing through the flow fan and the heat exchanger, the shroud for the motor driven axial flow fan having a central axis about which blades of the fan are arranged to rotate, the shroud comprising:

a housing having a circular ventilation opening where the fan and a mounting structure for the fan are located;

four arms extending radially from the housing toward a central axis, the arms supporting the fan mounting structure, the arms dividing the ventilating opening into four sections; and an air flow guide arrangement fixedly mounted and molded between the arms within the opening; the shroud being positioned and the air flow guide arrangement being such that the (a) engine is (i) downstream of the blades and (ii) positioned so that only some air blown by the blade fan is incident on the engine and (b) the air flow guide arrangement deflects air blown by the blades away from the engine and toward the alternator without having been incident on the engine, the flow fan being between (a) the heat exchanger and (b) the engine and alternator, the fan blades and the air flow guide arrangement being arranged so that air flowing through the heat exchanger flows through the plural sections of the opening and the blades, thence to the alternator, the air flow guide arrangement including plural radially displaced arcuately shaped air guide vanes located in only a first of the sections, said guide vanes being arranged to deflect the air flowing through the blades toward the central axis and the alternator and away from the engine, the first section being below the central axis and others of the sections, at least a portion of the engine being axially aligned with the first section, the first section extending downwardly from the mounting structure through an area ranging between about 90° to 180° from a top portion of the mounting structure.

2. The vehicle of claim 1 wherein the engine is radially displaced from the central axis and the alternator is radially displaced from the engine relative to the central axis.

3. The vehicle of claim 1 wherein the air flow guide arrangement is integrally formed as one piece with the arms within the opening.

4. An automotive vehicle comprising:

an engine;

a motor driven axial flow fan;

a shroud for the motor driven axial flow fan, the shroud for the motor driven axial flow fan having a central axis about which blades of the fan are arranged to rotate;

a heat exchanger; and an alternator displaced from the engine relative to an axis of flow for air flowing through the flow fan and the heat exchanger;

the shroud comprising:

a housing having a circular ventilation opening where the fan and a mounting structure for the fan are located, four arms extending radially from the housing toward the central axis, the arms supporting the fan mounting structure, the arms dividing the ventilating opening into four sections, and an air flow guide arrangement fixedly mounted between the arms within the opening; the shroud being positioned and the air flow guide arrangement being such that the (a) engine is (i) downstream of the blades and (ii) positioned so that only some air blown by the blade fan is incident on the engine and (b) the air flow guide arrangement deflects air blown by the blades away from the engine and toward the alternator without having been incident on the engine, the flow fan being between (a) the heat exchanger and (b) the engine and alternator, the fan blades and the air flow guide arrangement being arranged so that air flowing through the heat exchanger flows through the plural sections of the opening and the blades, thence to the alternator; the guide vanes including slats located in only a first of the sections and spaced radially from each other relative to the central axis, the radial spacing being arranged for enabling the air blown by the blades to flow between adjacent ones of the slats toward the central axis and the alternator and away from the engine, the first section being below the central axis and others of the sections, at least a portion of the engine being axially aligned with the first section, the first section extending downwardly from the mounting structure through an area ranging between about 90° to 180° from a top portion of the mounting structure.

5. The vehicle of claim 4 wherein the air flow guide arrangement is integrally formed as one piece with the arms within the opening.

* * * * *